US008668099B2

(12) United States Patent
Arecco

(10) Patent No.: US 8,668,099 B2
(45) Date of Patent: Mar. 11, 2014

(54) COMPACT TAMPER-PROOF CLOSURE

(75) Inventor: Mauro Arecco, Villa del Foro Alessandria (IT)

(73) Assignee: Guala Closures Patents B.V., Amsterdam (NL)

( * ) Notice: Subject to any disclaimer, the term of this patent is extended or adjusted under 35 U.S.C. 154(b) by 169 days.

(21) Appl. No.: 12/937,068

(22) PCT Filed: Mar. 24, 2009

(86) PCT No.: PCT/EP2009/053413

§ 371 (c)(1),
(2), (4) Date: Oct. 8, 2010

(87) PCT Pub. No.: WO2009/127496

PCT Pub. Date: Oct. 22, 2009

(65) Prior Publication Data

US 2011/0031209 A1 Feb. 10, 2011

(30) Foreign Application Priority Data

Apr. 16, 2008 (EP) ..... 08425255

(51) Int. Cl.
*B65D 51/16* (2006.01)
*B65D 25/38* (2006.01)

(52) U.S. Cl.
USPC ..... 215/311; 215/312; 220/714

(58) Field of Classification Search
USPC ..... 215/311, 312; 220/714, 717
See application file for complete search history.

(56) References Cited

U.S. PATENT DOCUMENTS

| | | | | |
|---|---|---|---|---|
| 2,673,655 | A * | 3/1954 | Greene | 215/22 |
| 4,382,520 | A * | 5/1983 | Aleff | 215/21 |
| 4,458,817 | A * | 7/1984 | Guala | 215/21 |
| 5,743,437 | A | 4/1998 | Moore et al. | |
| 2003/0000908 | A1 * | 1/2003 | Battegazzore | 215/20 |
| 2007/0138125 | A1 * | 6/2007 | Granger | 215/312 |
| 2007/0144998 | A1 * | 6/2007 | Plokhuta | 215/312 |

FOREIGN PATENT DOCUMENTS

| | | |
|---|---|---|
| DE | 29610125 U1 | 8/1996 |
| FR | 1316182 | 1/1963 |
| WO | 0151381 A2 | 7/2001 |
| WO | 2007087593 A2 | 8/2007 |

* cited by examiner

*Primary Examiner* — Mickey Yu
*Assistant Examiner* — Niki Eloshway
(74) *Attorney, Agent, or Firm* — Rothwell, Figg, Ernst & Manbeck PC

(57) ABSTRACT

The present invention concerns a compact closure for containers with a neck and mouth, comprising a threaded pourer (14) which has a drip-stop lip (19) and a threaded cap (3) designed to screw-engage with the threaded pourer, the pourer body comprising a part which has a cross-section substantially in the form of an upside-down "U" and the drip-stop lip being formed on the substantially annular upper portion (18) of the part with a cross-section in the form of an upside-down "U".

20 Claims, 2 Drawing Sheets

COMPACT TAMPER-PROOF CLOSURE

CROSS REFERENCE TO RELATED APPLICATION(S)

This application is a 35 U.S.C. §371 National Phase Entry Application from PCT/EP2009/053413 filed Mar. 24, 2009, and designating the United States. This application also claims the benefit of European Patent Application No. 08425255.0 filed Apr. 16, 2008, the disclosure of which is incorporated herein in its entirety by reference.

TECHNICAL FIELD

The present invention relates to a compact closure for containers with a neck and mouth, comprising a body comprising a threaded pourer, said threaded pourer being designed to be firmly fastened onto the mouth of said container and a threaded cap designed to screw-engage with said pourer.

BACKGROUND OF THE INVENTION

Tamper-proof closures are already known in the art, for example from EP 1511677 B1 in the name of Guala Closures Patents BV.

This type of closure comprises an externally threaded pourer onto which the cap is screwed.

The drip-stop lip of the threaded pourer is, however, formed on a longitudinal cylindrical structure of the pourer itself, which extends above the upper edge of the mouth of the container, resulting, however, in large longitudinal dimensions of the closure as a whole.

For some types of liqueurs (for example for some types of vodka) it is desirable, however, for example for marketing reasons, to provide a closure which is as compact as possible in the longitudinal direction. The results obtained hitherto, however, have not been satisfactory.

In view of the state of the art described, the object of the present invention is to provide a closure which overcomes at least partly the disadvantages mentioned above, by providing a closure which is an alternative to the known closures, while being more compact longitudinally.

SUMMARY OF THE INVENTION

In accordance with the present invention, this object is achieved by means of a compact closure for containers with a neck and mouth, comprising:

a body comprising a threaded pourer, said threaded pourer being designed to be firmly fastened onto the mouth of said container;

a threaded cap designed to screw-engage with said pourer;

wherein said pourer comprises an upper structure which has a substantially U-shaped cross-section, with an outer portion and an inner portion which are substantially cylindrical, and an upper portion which joins together said outer portion and inner portion.

BRIEF DESCRIPTION OF THE DRAWINGS

The characteristic features and advantages of the present invention will become clear from the following detailed description of a practical embodiment provided by way of a non-limiting example with reference to the accompanying drawings in which.

DETAILED DESCRIPTION

Figure 1:
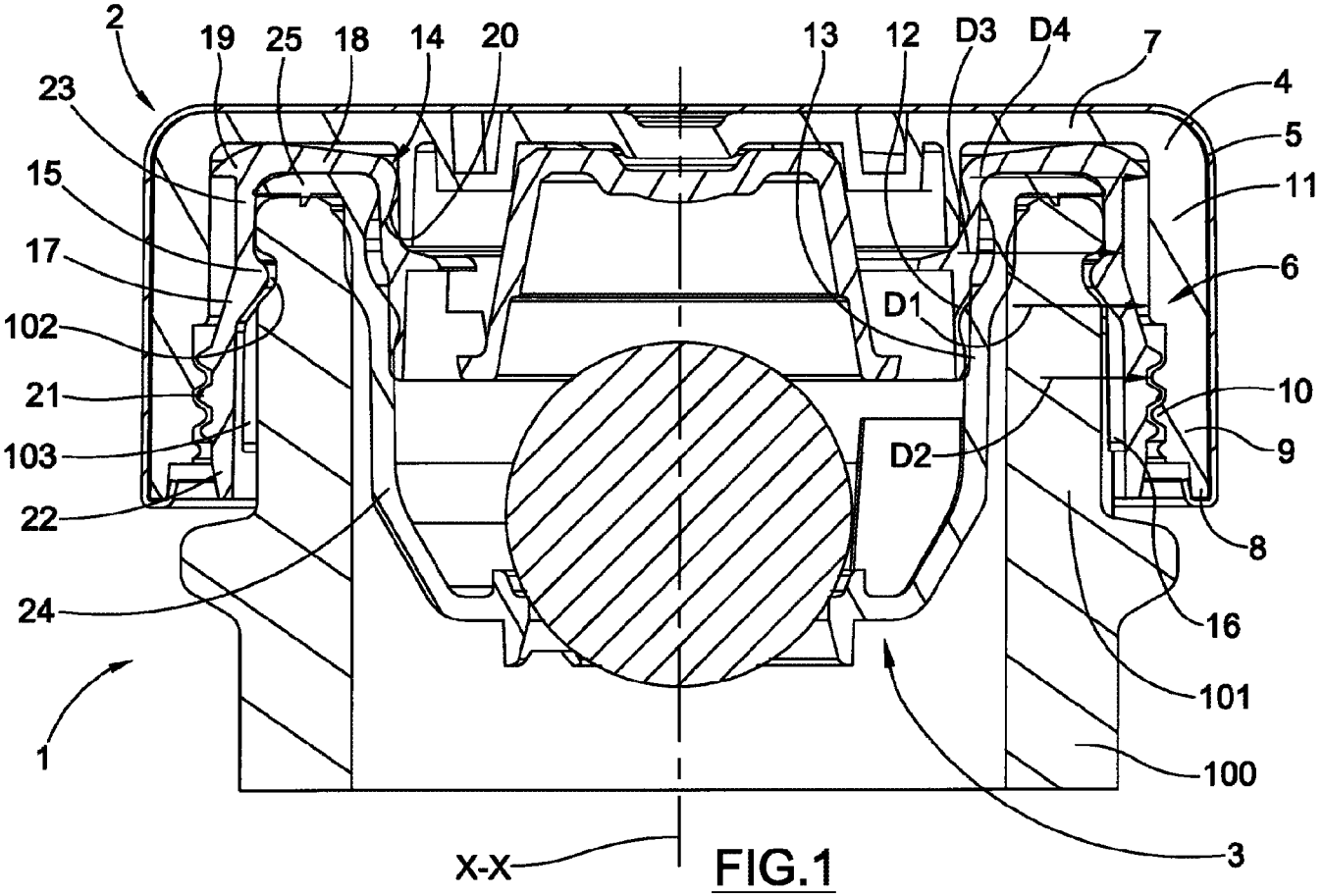
FIG. 1 shows a cross-sectional view of a closure according to a preferred embodiment of the present invention, in the closed configuration.

In the drawings all the parts are conventionally shown in their undeformed configuration so that it is possible to identify also the points where there are joints with an interference fit. The person skilled in the art will be able to easily find out such points.

With reference to the drawings, the closure 1 comprises a removable cap 2 and a body 3 designed to be firmly fastened to the mouth 101 of a container 100, for example a bottle. X-X denotes the main longitudinal axis which extends conventionally in the vertical direction.

Advantageously, the closure 1 has, before initial opening, a longitudinal extension less than a diameter, advantageously less than 0.5 of a diameter, for example less than 15 mm.

The cap 2 comprises a threaded undercap 4 which may be lined externally by a capsule 5 which can be made of metallic material, for example aluminum.

The undercap 4 comprises a cylindrical side wall 6 which is closed at the top by a closing wall 7. The bottom end 8 of wall 6 may advantageously have a smaller thickness (for example less than 0.8 mm) so as to allow capsule 5 to be folded back internally, as shown in FIG. 1.

Internally, wall 6 comprises a lower longitudinal section 9 which is adjacent to bottom end 8 and on which thread 10 is formed, and an upper longitudinal section 11 which is substantially smooth, namely without threading.

Advantageously, inner diameter D1 of upper longitudinal section 11 is substantially the same as or slightly smaller than the minimum diameter D2 of lower longitudinal section 9, namely the diameter defined by the crests of thread 10.

Closing wall 7 has the function of preventing the liquid from coming out of container 100 when closure 1 is closed. It may therefore be substantially flat and/or may comprise a cylindrical part 12 designed to sealingly engage with the inner wall of mouth 101 of container 100 or with an inner wall 13 of the body 3 of closure 1.

Body 3 of closure 1 comprises a pourer 14 which can be firmly fastened to mouth 101 of container 100 via a fastening device, for example a substantially annular inner tooth 15 which engages in a corresponding outer groove 102 formed on said mouth 101. Pourer 14 may also comprise an anti-rotation device, for example longitudinal ribs 16 which engage with corresponding ribs 103 formed on mouth 101 of container 100.

Pourer 14 therefore comprises an upper structure with a cross-section substantially in the form of a U (shown upside-down in the figures) where the vertical parts of the "U" are formed by an outer portion 17 and an inner portion 20 which are both cylindrical, and the horizontal part of the "U" is formed by an upper portion 18 which joins outer portion 17 to inner portion 20.

Pourer 14 may or may not have a drip-stop lip 19, which if present, is formed directly on the outer end of the upper portion, without need for any cylindrical part projecting upwards, namely it projects radially outwards as a continuation of upper portion 18 (like the sloping surface of a roof).

The anti-rotation device and the fastening device are advantageously formed on outer portion 17, while inner portion 20 is seated inside mouth 101 of container 100.

Threaded portion 21 of body 3 is advantageously formed in the vicinity of bottom end 22 of outer portion 17 and is connected to upper portion 18 by means of a connecting section 23 with a smaller diameter D3, advantageously smaller than D4.

The drip-stop lip 19 projects outside section 23 and has a maximum diameter D4, greater than D3, for example by a few tenths of a mm. In the preferred embodiment shown, this difference is about 0.7 mm. Preferably D4 is linked to D3 by means of a substantially horizontal surface which may be aligned with the lower surface of upper portion 18.

Figure 2:
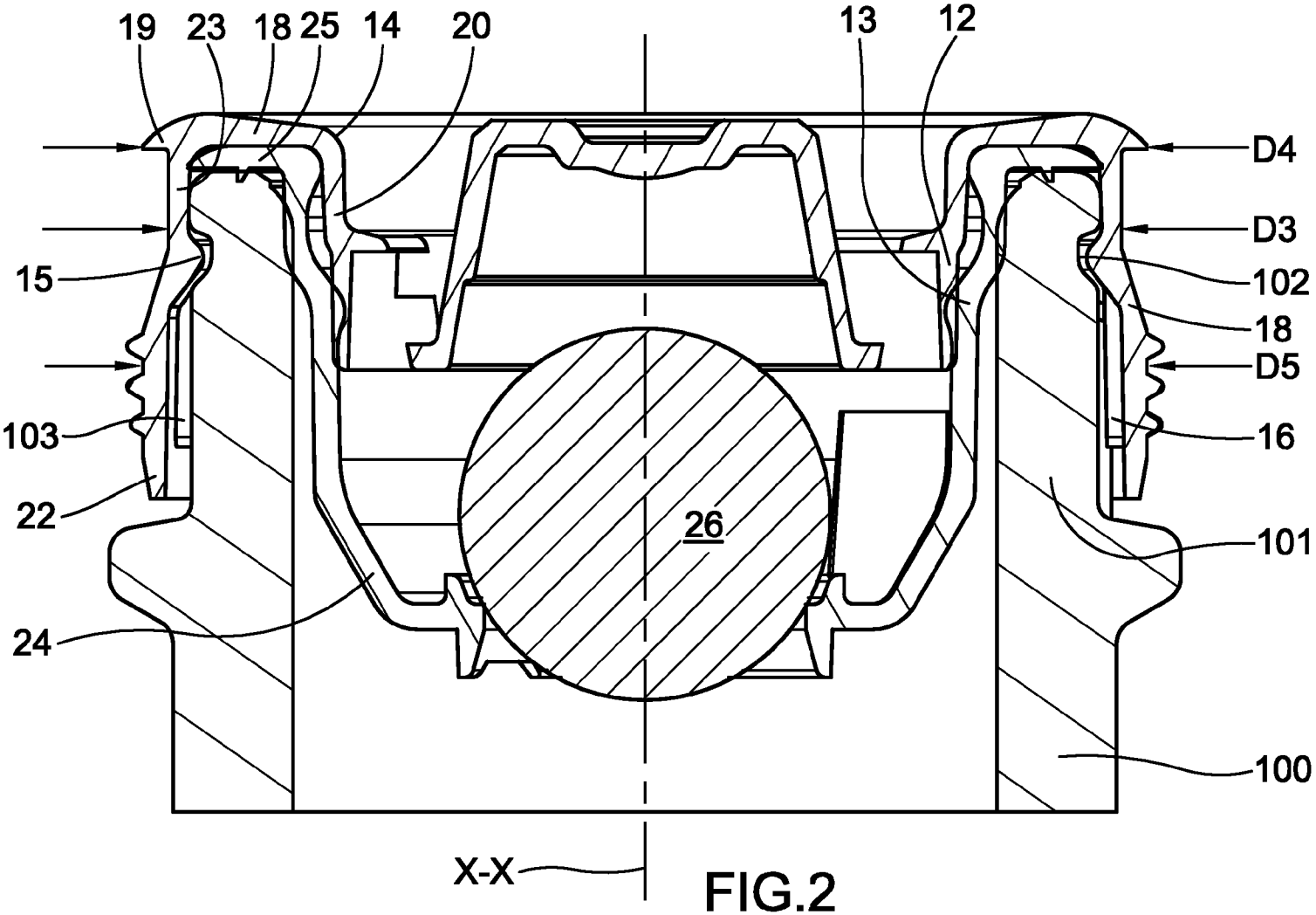
FIG. 2 shows a cross-sectional view of the closure according to FIG. 1, in the open configuration.

Viewed in cross-section, as in FIGS. 1 and 2, the upper surface of upper portion 18 is preferably convex: from the inside outwards there is a first ascending section (conical in the figures) and a second descending section (convex in the figures), the outer part of which coincides with the upper surface of drip-stop lip 19.

Advantageously, the first ascending section has a radial extension greater than that of the second descending section, namely the crest of the convex portion is arranged along the radially outermost half of upper portion 18. With regard to diameters D1-D5, in a closure according to the preferred embodiment all the conditions below exist; in less advantageous embodiments, on the other hand, it is possible that there may be only some (or even none) of them.

The diameter D4 may be substantially the same as or slightly smaller than diameter D2 such that thread 10 may easily pass over drip-stop lip 19 both during opening and during closing; diameter D4 may be substantially the same as or slightly smaller than diameter D1; inner diameter D5 of the valleys of threads 21 of pourer 14 may be substantially the same as outer diameter D4 of drip-stop lip 19 such that drip-stop lip 19 may perform a guiding function for cylindrical portion 11, facilitating (also during manufacture of closure 1) screwing of cap 2 onto body 3 of closure 1, which is otherwise made difficult by the small longitudinal extension of threads 10, 21.

The closure 1 may comprise an anti-refilling device, for example a washer 24 with an outer flange 25 resting on the upper edge of mouth 101 of container 100.

Washer 24 may in turn comprise a seat for a ball valve 26 or for a siphon system (not shown). A second part of the filling-prevention system, for example the system for retaining the ball valve at the top, may be incorporated in pourer 14.

Inner wall 13 mentioned above may therefore be formed directly by washer 24.

Advantageously, undercap 4, pourer 14 and washer 24 are made of polymer material, by injection moulding; pourer 14 may be made of polymer material which is preferably rigid, such as HIPS (high-impact polystyrene), PP (polypropylene) or PC (polycarbonate).

Obviously, a person skilled in the art, in order to satisfy contingent and specific requirements, may make numerous modifications and variations to the configurations described above, for example the diameters indicated as being slightly different may differ by up to 3-4% with respect to each other.

These variations and modifications are, moreover, all contained within the scope of protection of the invention as defined by the following claims.

The invention claimed is:

1. A compact closure for containers with a neck and mouth, comprising:

a body comprising a threaded pourer, said threaded pourer being designed to be firmly fastened onto the mouth of said container;

a threaded cap designed to screw-engage with said threaded pourer, wherein said threaded pourer comprises an upper structure which has a substantially U-shaped cross-section, with an outer portion and an inner portion which are substantially cylindrical and coaxial, and an upper portion which transversally joins together said outer portion and inner portion, and wherein an upper surface of said upper portion is convex in cross-section, and from inside outward, said upper surface has a first ascending section and a second descending section; and a drip-stop lip formed directly on the outer end of said upper portion without any cylindrical part projecting upwards so that said drip-stop lip projects radially outwards as a continuation of said upper portion, such that an upper surface of said drip-stop lip corresponds to at least a portion of said upper surface of said upper portion, wherein an outer part of said second descending section coincides with said upper surface of said drip-stop lip such that the drip-stop lip extends below said upper surface of the upper portion.

2. The closure according to claim 1, in which the cross-section of said upper portion is substantially convex.

3. The closure according to claim 1, in which the valleys of the threads of said pourer have an inner diameter D5 which is substantially the same as the outer diameter D4 of said drip-stop lip.

4. The closure according to claim 1, in which said threaded pourer comprises a section joining together said drip-stop lip and the threaded portion, said joining section having an outer diameter D3 smaller than D4.

5. The closure according to claim 1, in which said drip-stop lip has an outer diameter D4, said cap comprises a threaded undercap comprising a longitudinal upper section with an inner diameter D3 and said outer diameter D4 is substantially the same as or slightly smaller than D3.

6. The closure according to claim 1, in which said cap comprises an overcap and a threaded undercap which are fastened together.

7. The closure according to claim 1 comprising an anti-refilling device, comprising at least one of a valve, a ball valve or a siphon.

8. The closure according to claim 1, having longitudinal extension less than 0.5 diameters and/or less than 15 mm.

9. The closure according to claim 1, in which said pourer comprises an anti-rotation device which engages with the mouth of said container.

10. The closure according to claim 1, in which said body comprises a threaded portion, formed in the vicinity of a bottom end of the outer portion of said body.

11. The closure according to claim 1, in which said pourer is firmly fastened to the mouth of said container via a substantially annular inner tooth which engages in a corresponding outer groove formed on said mouth.

12. The closure according to claim 1, in which said pourer is made of a rigid polymer material.

13. The closure according to claim 12, in which said threaded pourer is made of HIPS (high-impact polystyrene), PP (polypropylene) or PC (polycarbonate).

14. The closure according to claim 1, in which crests of the threads of said cap have an inner diameter D2 which is substantially the same as or slightly larger than an outer diameter D4 of said drip-stop lip.

15. The closure according to claim 1, wherein:

said threaded pourer has a threaded portion and a connecting section joining together said drip-stop lip and said threaded portion, said connecting section has an outer diameter D3, said drip-stop lip projects outside said connecting section and has a maximum diameter D4 greater than said outer diameter D3, said maximum diameter D4 of said drip-stop lip is linked to said outer diameter D3 of the connecting section by means of a substantially horizontal surface.

16. The closure according to claim 15, wherein said substantially horizontal surface is aligned with a lower surface of said upper portion.

17. The closure according to claim 16, wherein said connecting section joins together said threaded portion and said upper portion on which said drip-stop lip is formed directly.

18. The closure according to claim 15, wherein said connecting section joins together said threaded portion and said upper portion on which said drip-stop lip is formed directly.

19. The closure according to claim 1, wherein said drip-stop lip is delimited upwardly by said second descending portion.

20. The closure according to claim 1, wherein said drip-stop lip is delimited upwardly by the upper surface of said second descending portion.

* * * * *